US007325703B2

(12) United States Patent
Gherdan et al.

(10) Patent No.: US 7,325,703 B2
(45) Date of Patent: Feb. 5, 2008

(54) MULTI-CAVITY BLISTER PACKAGE FOR STORING AND DISPENSING FLOWABLE SUBSTANCES

(75) Inventors: Victor Gherdan, Cherry Hill, NJ (US); Dennis Chadwick, Ottsville, PA (US); David Barndt, Richlandtown, PA (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 127 days.

(21) Appl. No.: 11/154,356

(22) Filed: Jun. 16, 2005

(65) Prior Publication Data

US 2006/0283761 A1 Dec. 21, 2006

(51) Int. Cl.
*B65D 35/22* (2006.01)

(52) U.S. Cl. ..... 222/94; 222/107; 222/541.9; 206/219; 206/469; 206/484; 206/824

(58) Field of Classification Search ..... 222/541.6, 222/541.9, 107, 94; 206/219, 469, 484, 824, 206/484.2
See application file for complete search history.

(56) References Cited

U.S. PATENT DOCUMENTS

| | | | | |
|---|---|---|---|---|
| 3,197,071 | A | 7/1965 | Kuster | 222/94 |
| 3,521,805 | A * | 7/1970 | Ward | 206/539 |
| 3,685,648 | A * | 8/1972 | Heller | 206/462 |
| 3,689,458 | A * | 9/1972 | Hellstrom | 206/530 |
| 4,140,409 | A * | 2/1979 | DeVries | 401/132 |
| 4,200,193 | A * | 4/1980 | Boyle | 206/461 |
| 4,664,257 | A * | 5/1987 | Nilson | 206/219 |
| 4,790,429 | A * | 12/1988 | Fukushima | 206/219 |
| 4,871,091 | A | 10/1989 | Preziosi | 222/92 |
| 4,903,842 | A * | 2/1990 | Tokuda et al. | 229/123.1 |
| 5,395,031 | A * | 3/1995 | Redmond | 222/541.6 |
| 5,509,898 | A | 4/1996 | Isono et al. | 604/87 |
| 5,843,409 | A | 12/1998 | Campbell et al. | 424/52 |
| 5,954,231 | A | 9/1999 | Durliat et al. | 222/1 |
| 6,247,617 | B1 | 6/2001 | Clyde et al. | 222/94 |
| 6,260,735 | B1 | 7/2001 | Fuquen | 222/94 |
| 6,345,733 | B1 | 2/2002 | Bennett | 222/94 |
| 6,543,209 | B1 * | 4/2003 | Siegel et al. | 53/492 |
| 6,612,769 | B2 | 9/2003 | Lee et al. | 401/183 |
| 2003/0019883 | A1 | 1/2003 | De Laforcade | 222/1 |
| 2003/0075561 | A1 | 4/2003 | Pieri | 222/94 |
| 2003/0222099 | A1 | 12/2003 | Keller | 222/94 |

* cited by examiner

*Primary Examiner*—J. Casimer Jacyna
(74) *Attorney, Agent, or Firm*—Fitzpatrick, Cella, Harper & Scinto

(57) ABSTRACT

A single-use, multi-chamber package for housing and common administration of at least two flowable substances. The package includes at least first and second product storage cavities; and at least first and second product application channels. At least one separation line selectively reduces the strength of a predetermined area of the package and generally defines a tab. Steps of use include: 1) applying a force to tab creation areas to separate a portion of a tab; 2) removing the tab from the blister package by tearing across the product application channels to form wings, exposing the interior of the product application channels; 3) rotating the wings to pivot the channel openings toward one another, and 4) applying a force to the storage cavities to dispense the products. The package may contain more than two substances by employing multiple storage cavities and application channels.

37 Claims, 10 Drawing Sheets

MULTI-CAVITY BLISTER PACKAGE FOR STORING AND DISPENSING FLOWABLE SUBSTANCES

TECHNICAL FIELD

The present invention generally relates to multi-cavity blister packages containing various flowable substances, especially for medication packaging in which separate components are simultaneously dispensed.

BACKGROUND OF THE INVENTION

Measured amounts of various fluid substances are increasingly commonly dispensed in relatively small flexible packages often composed of plastic or foil. The fluids include a wide variety of products, including foodstuffs such as condiments, personal care products such as shampoos, and pharmaceutical products such as medications.

A typical example is that of the ubiquitous single serving ketchup pack, which is generally formed of two sheets of foil or plastic, superimposed over one another, and then sealed together around the periphery, with a notch or other means to facilitate tearing one edge away from the container. The user tears open the container, dispenses the condiment, and then disposes of the package. More sophisticated examples include varieties of BFS (blow-fill-seal) packaging, in which a frangible plastic shell is blown, filled with a fluid, and then sealed, in a continuous operation. Some portion of the BFS container formed by this method is severed or otherwise broken at the time of use, and the fluid is dispensed, most often by manually squeezing the container.

These types of packages, while effective for certain types of fluids, are particularly troublesome for packaging designed to dispense more than a single discrete fluid at the same time. The need for such a dispensing apparatus arises from the fact that many substances, particularly medicaments, are preferably stored as separate components that are optimally mixed at the time of dispensing and use. Often, this is due to the fact that such components, when combined, result in mixtures that are either unstable or have a limited shelf life after mixing. An example of a simple dispensing container of this nature is seen in U.S. Pat. No. 5,843,409 ('409) to Campbell et al., in which separate compartments of a dentifrice tube may be squeezed, expelling separate components from an egress neck that, when not in use, is covered by a cap commonly covering both fluid compartments.

Various problems present themselves in designing a package designed to seal the component fluids from the environment, and then after the seal is broken, to mix and dispense more than a single discrete fluid at one time. Firstly, since such packaging must allow for the simultaneous and controlled opening of separate chambers, the opening mechanism must irreversibly and cleanly open all fluid containing chambers. The packaging can be quite difficult to open, particularly for those with arthritic hands or otherwise weakened grip strength. This difficulty is exacerbated by the fact that the container must be relatively strong in order to contain the contents under normal handling conditions, which may include accidental compression. Even a small amount of moisture or skin oil on the surface of the packaging can make gripping and tearing the often small package nearly impossible. It is extremely common to see frustrated users of such packaging using their teeth to open ostensibly manually "tear open" packages. Such a technique poses obvious aesthetic and hygienic issues; not to mention the dangers associated with products that are not safe for oral contact. A typical example of such packaging is seen in U.S. Pat. No. 6,247,617 ('617) to Clyde et al., in which side-by-side fluid chambers within a single container are each connected by egress necks to a common seal. When the seal is broken, the fluid may be expelled from the chambers.

Such packaging raises problems of its own. Firstly, it can be difficult to grasp the container tightly enough to grip it and break off the dispensing neck without putting significant pressure on the sidewalls of the fluid filled chambers. Then, when the dispensing neck breaks off, a possibly considerable amount of the chamber contents can be prematurely expelled. Secondly, the goal of the separated chambers is generally to effect a mixing in a predetermined ratio of the fluids. One method to achieve such a predetermined ratio is seen in U.S. Pat. No. 3,197,071 ('071) to Kuster, in which it is specified that the egress necks of the separated chambers may be varied in size so as to achieve a desired ratio of the mixture of the fluids. Depending on the volume and viscosity of the fluids, it may be difficult to achieve the correct ratio. Particularly, if more pressure is exerted on one chamber than on another, as may easily be done when manually gripping side by side chambers such as those described in the '617 device, there can be marked variation in the amount of contents expelled from each of the chambers. As an additional issue, many substances are ideally packaged in child-resistant form, to protect young children from accessing the contents.

SUMMARY OF THE INVENTION

In its most general configuration, the present invention advances the state of the art with a variety of new capabilities and overcomes many of the shortcomings of prior art in new and novel ways. In its most general sense, the present invention overcomes the shortcomings and limitations of the prior art in any of a number of generally effective configurations. The instant invention demonstrates such capabilities and overcomes many of the shortcomings of prior devices.

The instant invention includes a multi-cavity blister package for housing and common administration of at least two flowable substances, which may be liquids. The blister package includes a blister layer and a base layer, in-part joined together, and is intended for single-use; meaning broadly that the substances are intended to be substantially or completely dispensed or expelled from the package upon package opening.

The blister package has a perimeter, an administration end, and a gripping end, among other dimensions and structures. A blister layer is formed to have at least a first product storage cavity and a second product storage cavity. The blister layer is also formed with at least a first and second product application channel in fluid communication with the respective first and second product storage cavities. Each product application channel has a proximal end, nearest the respective storage cavity, and a distal end, nearest the blister package administration end.

The shape and size of the cavities and the channels is generally selected based upon the characteristics of the flowable substances and the quantity of the substances that must be delivered. The cavities and the channels may be virtually any shape and size, and the cross-sectional area of the channels may vary along the length of the channel, most commonly illustrated as a tapering of the channel(s). In fact, as will be detailed below, in some embodiments there may be virtually no distinction between the cavities and the channels. In a common embodiment, the cavities are generally semi-spherical and the channels are generally semi-circular in cross-section.

The product storage cavities and product application channels do not extend to the edge of the package, thus minimizing the likelihood of accidental release of the flowable substances. In one particular embodiment, each storage cavity is generally designed to hold between approximately 0.1 cc and approximately 5 cc of flowable substances.

The blister layer and base layer may have at least one separation line that selectively reduces the strength of the layers and generally defines a substantially overlying tab creation area in both layers that facilitates the creation of a tab. In some embodiments, creation of the tab requires application of force to the tab creation areas to break a portion of the tab free from the remainder of the blister package.

Generally, at least a portion, more preferably, at least a 3.0 mm wide surface area of the base layer interior surface is joined to the blister layer interior surface such that the base layer seals the interior of the storage cavities and product application channels from the exterior environment.

A user accesses the flowable substances by generally, 1) applying a force to the tab creation areas to separate a portion of the package to form a tab; 2) removing the tab from the blister package by tearing the tab across the product application channels to form wings, thereby exposing the interior of the product application channels; 3) rotating the wings so that the channel openings pivot toward one another, and 4) applying a force to the blister package to dispense the substances.

The shape and make-up of the separation lines need only facilitate the creation of the tab from application of a reasonable amount of force, and the shape and make-up of the separation lines may be selected to create a tab of a predetermined shape and/or having a predetermined tendency to tear. In one embodiment, the separation lines are a substantially concave shape that opens toward the administration end, thus cooperating with the natural tendency of a user to grip the blister package with one hand at the gripping end and utilize the opposite hand to manipulate the administration end. The addition of at least one tab retention projection increases the amount of force that must be applied to create the tab.

Once the tab is torn from the blister package, one or both wings may be rotated so that the channel openings pivot toward one another. Fold promoting features may be employed to reduce the rigidity of the package and to promote the rotation of the wing or wings. The fold promoting features may also provide a visual indication to the user as to the location about which to fold the wings.

In various embodiments of the present invention, numerous elements are symmetric about a line of symmetry. Further, embodiments incorporating fold promoting features may locate these features substantially on the line of symmetry, thus taking advantage of the user's natural tendency to fold items in half.

The cavities and the channels may be identical in size and shape or may vary. It is often desirable to dispense different quantities of the first flowable substance and the second flowable substance. Further, the viscosity of two flowable substances that need to be stored separately until application is rarely the same. It is not uncommon to have one flowable substance with thickness and flow characteristics similar to toothpaste that must be applied with a second flowable substance having thickness and flow characteristics more similar to water. In such a situation, it is desirable to have the channels sized to control the distribution of the substances so that they may be dispensed evenly, or in a predetermined ratio.

The product application channels may be angulated to form a discharge convergence angle of between zero degrees (0° or parallel), or convergent (i.e., +20°), or divergent (i.e., −20°). What is important is that the tear path intersects the end tips of the product application channels.

In most of the embodiments, the blister package is designed such that the location of the first channel opening is symmetric about the line of symmetry with the second channel opening, thereby placing the openings adjacent to one another when the wings are folded in an adjacent manner. Such positioning ensures that the substances exit their associated openings in a side-by-side fashion. Such discharge of the substances enables mixing of the substances at the point of application. Further, the design of the blister package, and specifically the tab and its predetermined tear path, eliminate the possibility of only opening one of the application channels and improperly administering the flowable substances. In an alternative embodiment, the channel openings are configured so that one of the substances is applied first and the second substance is applied over, or on top of, the previously applied substance.

In one particular embodiment, the centers of the cavities are symmetric about the line of symmetry, as are the centerlines of the channels. Such a configuration is particularly effective because as the wings are folded together. This is in large part due to the fact that the blister package is designed to conveniently fit between the thumb and forefinger of an adult hand so that the folding of the package and associated flattening of the cavities is accomplished with one hand. One with skill in the art will appreciate that the present design makes it virtually impossible to not apply approximately the same force to each cavity when the package is gripped and squeezed between the thumb and forefinger of a single hand, regardless of whether the package is folded such that the blister layer comes in contact with itself, or the base layer comes in contact with itself.

To increase the child-resistance of the blister package, the base layer is comprised of a material and thickness that cannot be ruptured by a person pushing on the product storage cavities. Additionally, the child-resistance is further increased by the fact that peeling, or separation, of the base and blister layers from one another by human fingers is extremely difficult, if not impossible.

The blister package may contain more than two substances, for example, the blister package may further comprise a third storage cavity and a third product application channel for housing and applying a third flowable substance; or even additional storage cavities and application channels may be employed.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

Figure 1:
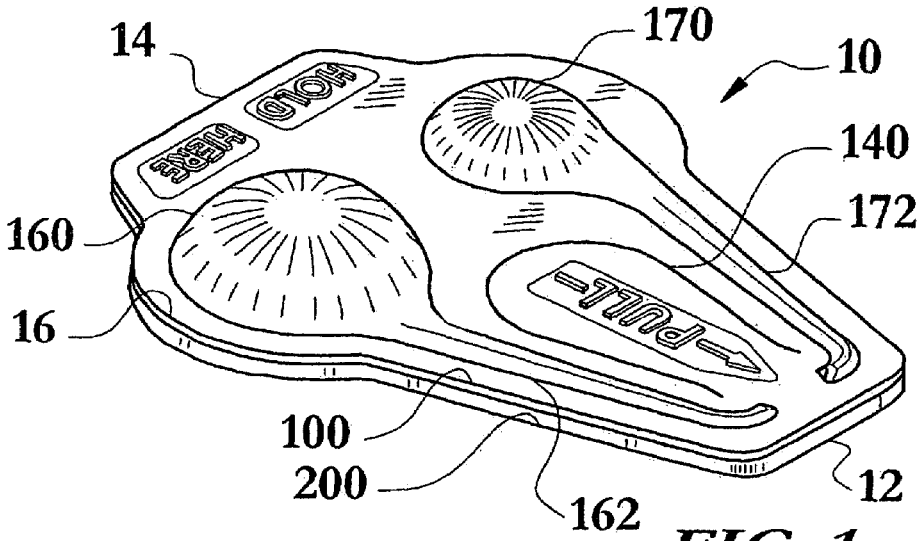
FIG. 1 is a perspective view of an embodiment of the multi-cavity blister package in accordance with the present invention.

The multi-cavity blister package of the instant invention enables a significant advance in the state of the art. The preferred embodiments of the apparatus accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention as claimed.

Referring generally to FIGS. 1 through 21, the instant invention includes a multi-cavity blister package (10) for housing and common administration of at least a first flowable substance (S1) and a second flowable substance (S2). The blister package (10) includes a blister layer (100) and a base layer (200), in-part joined together. The blister package (10) of the present invention is a single-use package, meaning broadly that the single-use blister package (10) houses substances (S1, S2) to be substantially or completely dispensed or expelled from the package (10) upon opening of the package (10).

With reference to FIGS. 1-5, the blister package (10) has a perimeter (16), an administration end (12), a gripping end (14), a maximum longitudinal length (18), and a maximum transverse width (20). Additionally, the blister layer (100) has a blister layer perimeter (110) with one or more exterior edges (112), a blister layer exterior surface (120), and a blister layer interior surface (130). Similarly, the base layer (200) has a base layer perimeter (210) with one or more exterior edges (212), a base layer exterior surface (220), and a base layer interior surface (230).

The blister layer (100) is formed to have at least a first product storage cavity (160) and a second product storage cavity (170). The blister layer (100) is also formed with at least a first product application channel (162) in fluid communication with the first product storage cavity (160), and a second product application channel (172) in fluid communication with the second product storage cavity (170). The first product application channel (162) has a proximal end (166), nearest the first product storage cavity (160), and a distal end (167), nearest the blister package administration end (12). Similarly, the second product application channel (172) has a proximal end (176), nearest the second product storage cavity (170), and a distal end (177), nearest the blister package administration end (12).

Figure 16:
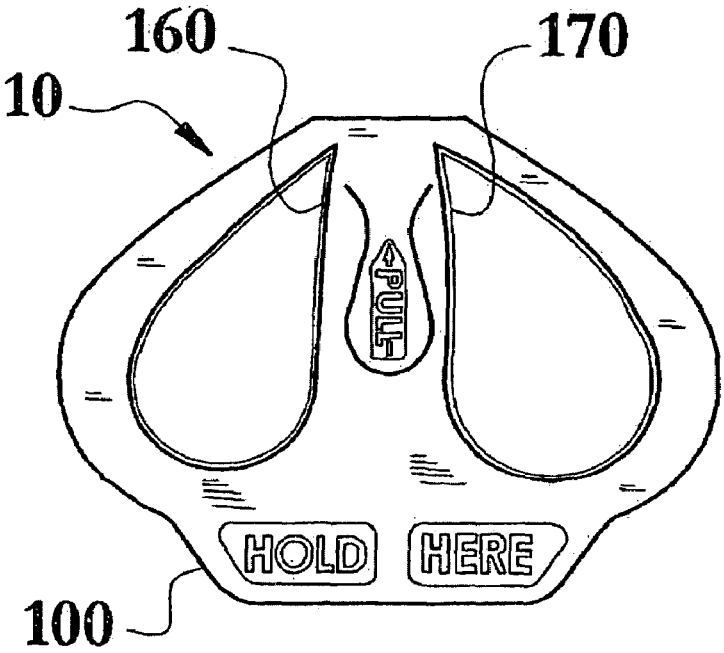
FIG. 16 is a top plan view of an embodiment of the blister package in accordance with the present invention.

The cavities (160, 170) and the channels (162, 172) may be virtually any shape and size. In fact, in some embodiments there may be virtually no distinction between the cavities (160, 170) and the channels (162, 172), as seen in FIG. 16. The shape and size of the cavities (160, 170) and the channels (162, 172) is generally selected based upon the characteristics of the flowable substances (S1, S2) and the quantity of the substances (S1, S2) that must be delivered. The flowable substances (S1, S2) may include powdered compositions, dry granule substances, gels, foams, liquids, and any other material that has a tendency to flow under some environmental conditions. In the medical arts, such substances (S1, S2) may be pharmaceutically active compositions and/or pharmaceutically acceptable diluents. In the embodiments illustrated in FIGS. 1-4 and 17-21, the cavities (160, 170) are generally semi-spherical and the channels (162, 172) are generally semi-circular in cross-section; however, one with skill in the art will appreciate that virtually any shapes may be used. Additionally, the cross-sectional area of the channels (162, 172) may vary along the length of the channel, most commonly illustrated as a tapering of channel(s) (162, 172). It is important to note that the first product storage cavity (160), the second product storage cavity (170), the first product application channel (162), and the second product application channel (172) do not extend to the blister layer perimeter (110), thus minimizing the likelihood of accidental release of the flowable substances (S1, S2). In one particular embodiment, each of the storage cavities (160, 170) is generally designed to hold between approximately 0.1 cc and approximately 5 cc of flowable substances (S1, S2). In this embodiment, the blister package maximum longitudinal length (18) is between approximately three to approximately five inches and the maximum transverse width (20) is between approximately two inches and approximately four inches. The location and configuration of the cavities (160, 170) and the channels (162, 172) will be disclosed in greater detail later herein.

Figure 2:
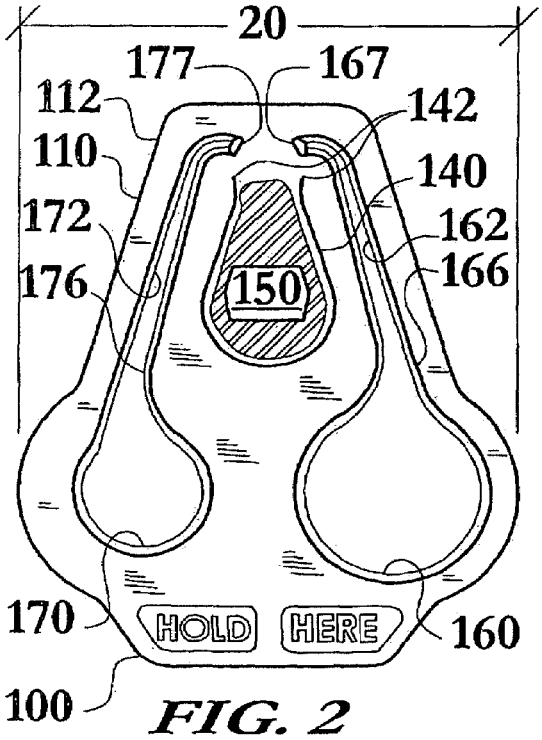
FIG. 2 is a top plan view of the embodiment of the blister package of FIG. 1.

The blister layer (100) has a blister layer tab creation separation line (140), having two endpoints (142), located interior to the blister layer perimeter (110), as seen in FIG. 2. The blister layer tab creation separation line (140) acts by selectively reducing the strength of the blister layer (100). Similarly, the base layer (200) has a base layer tab creation separation line (240), having two endpoints (242), located interior to the base layer perimeter (210), as seen in FIG. 2. The base layer tab creation separation line (240) acts by selectively reducing the strength of the base layer (100). Further, the blister layer tab creation separation line (140) generally defines a blister layer tab creation area (150) and the base layer tab creation separation line (240) generally defines a base layer tab creation area (250). The purpose of the tab creation separation lines (140, 240) is to facilitate the creation of a tab (300), seen first in FIG. 6. In some embodiments, described in greater detail elsewhere, creation of the tab (300) requires application of force to the tab creation areas (150, 250) to break a portion of the tab (300) free from the remainder of the blister package (10).

Generally, at least a portion, more preferably at least a 3.0 mm wide surface area of the base layer interior surface (230) is joined to the blister layer interior surface (130) such that the base layer (200) seals the interior of the first product storage cavity (160), the second product storage cavity (170), the first product application channel (162), and the second product application channel (172) from the exterior environment. The blister layer (100) may be joined to the base layer (200) by heat sealing, adhesive such as heat-activated adhesive that has been pre-applied to the base layer (200), solvent adhesive, RF or sonic seal, or by other suitable means. The areas of the blister layer (100) that are formed into the storage cavities (160, 170) and the channels (165, 175) are obviously not joined to the base layer (200). The layers (100, 200) are joined such that the base layer tab creation separation line (240) and the blister layer tab creation separation line (140) substantially overlay one another and the base layer tab creation area (250) and the blister layer tab creation area (150) substantially overlay one another.

Figure 6:
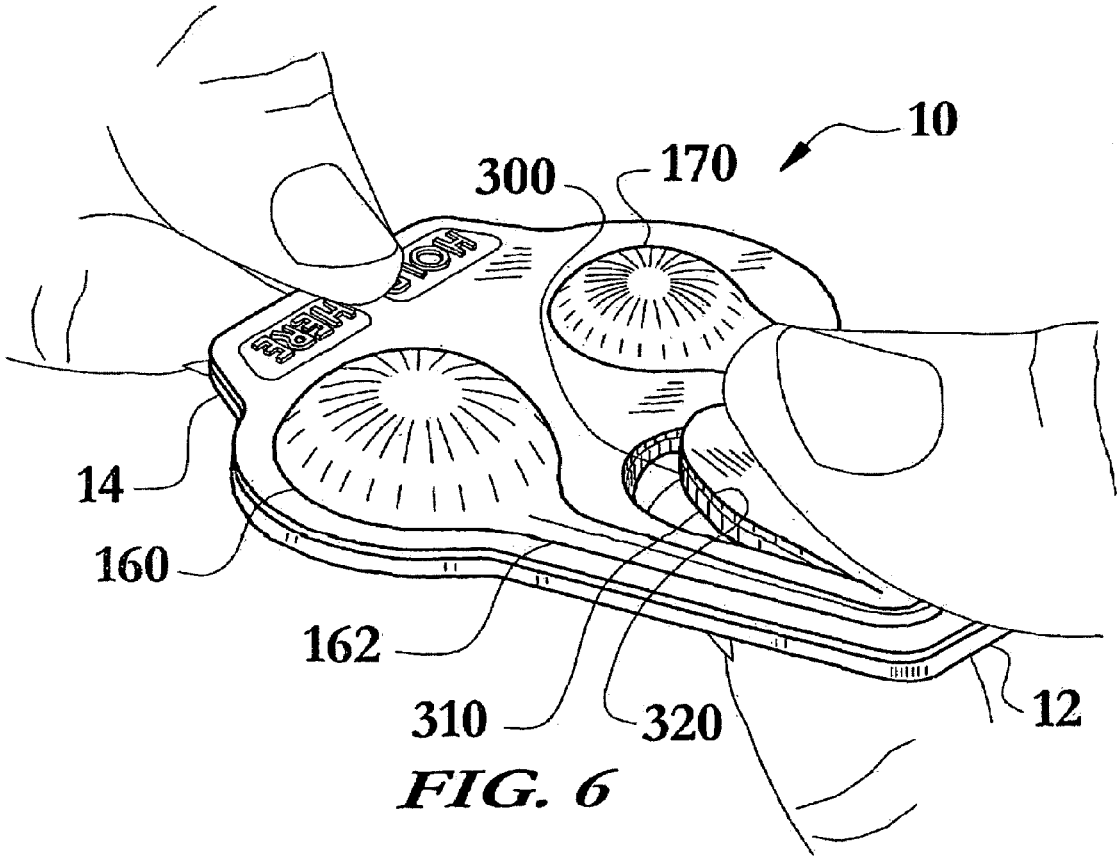
FIG. 6 is a perspective view of an embodiment of the blister package as a user may grip it and pull the tab.
Figure 7:
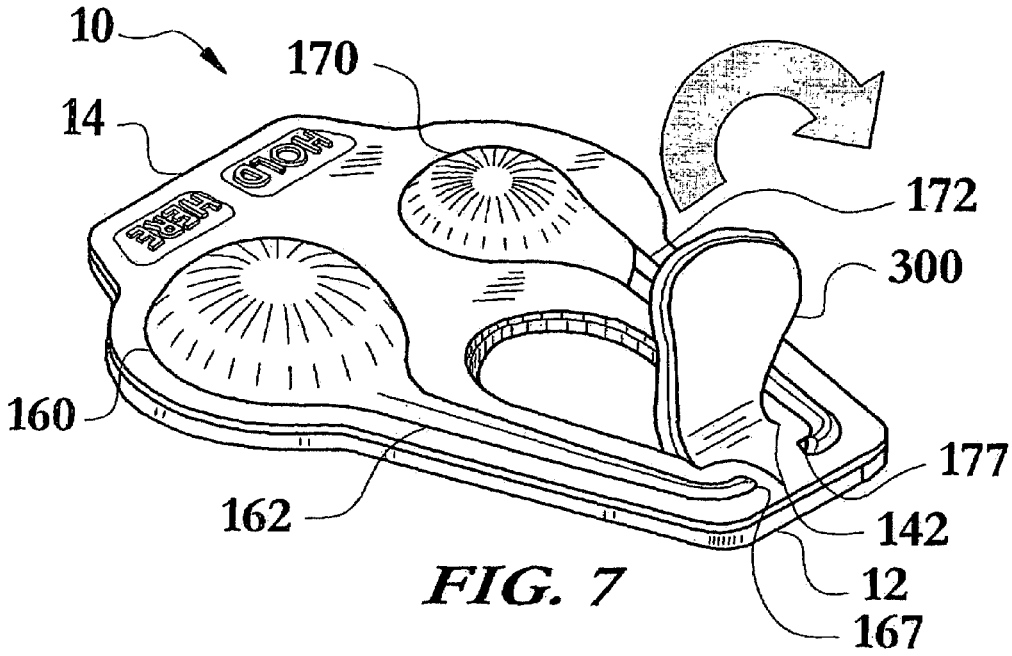
FIG. 7 is a perspective view of the embodiment of the blister package of FIG. 6 illustrating separation of the tab along the blister layer tab creation separation line and base layer tab creation separation line, having the tab bent in a plane orthogonal to the base layer.
Figure 8:
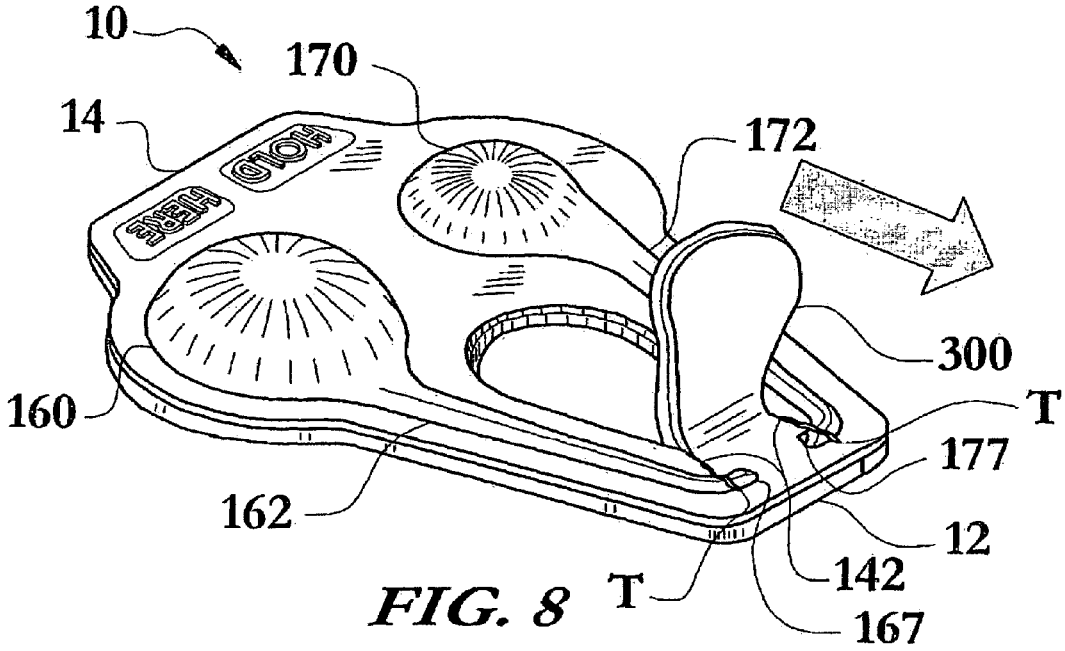
FIG. 8 is a perspective view of the embodiment of the blister package of FIG. 7 illustrating propagation of a tear towards the blister package perimeter across the product application channels.
Figure 9:
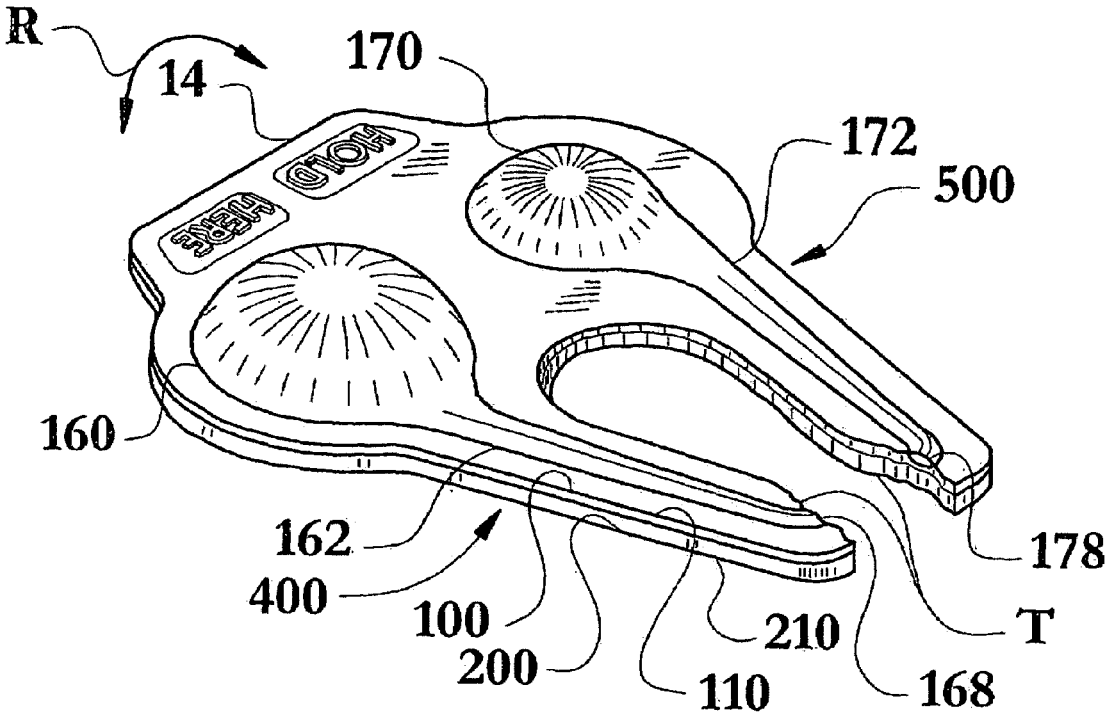
FIG. 9 is a perspective view of an embodiment of the blister package of FIG. 6 following removal of the tab by the process illustrated in FIGS. 7 and 8 above, thereby exposing the sinistral wing and the dextral wing.
Figure 10:
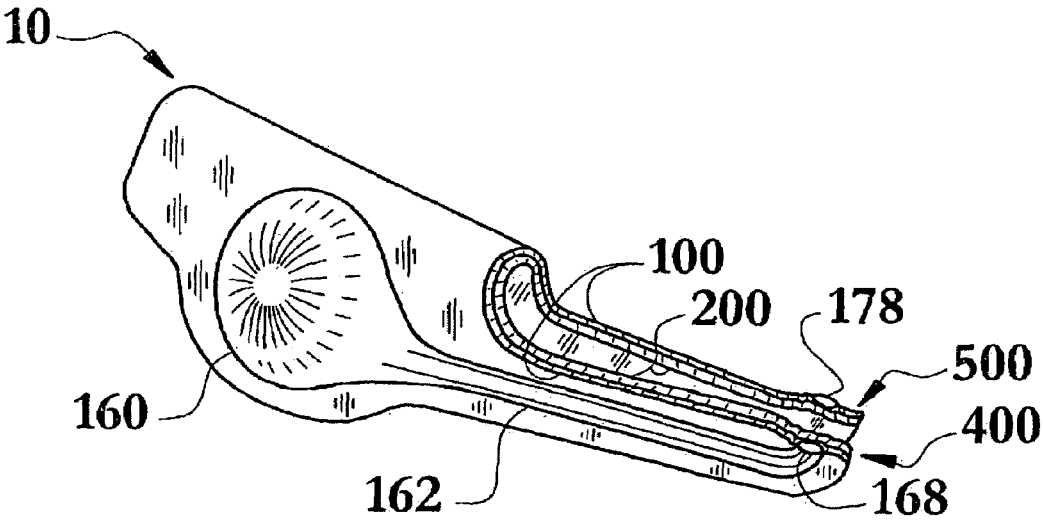
FIG. 10 is a perspective view of an embodiment of the blister package with the tab removed thereby exposing the sinistral wing and the dextral wing and an indication of one means of manipulating the wings, in accordance with the present invention.
Figure 11:
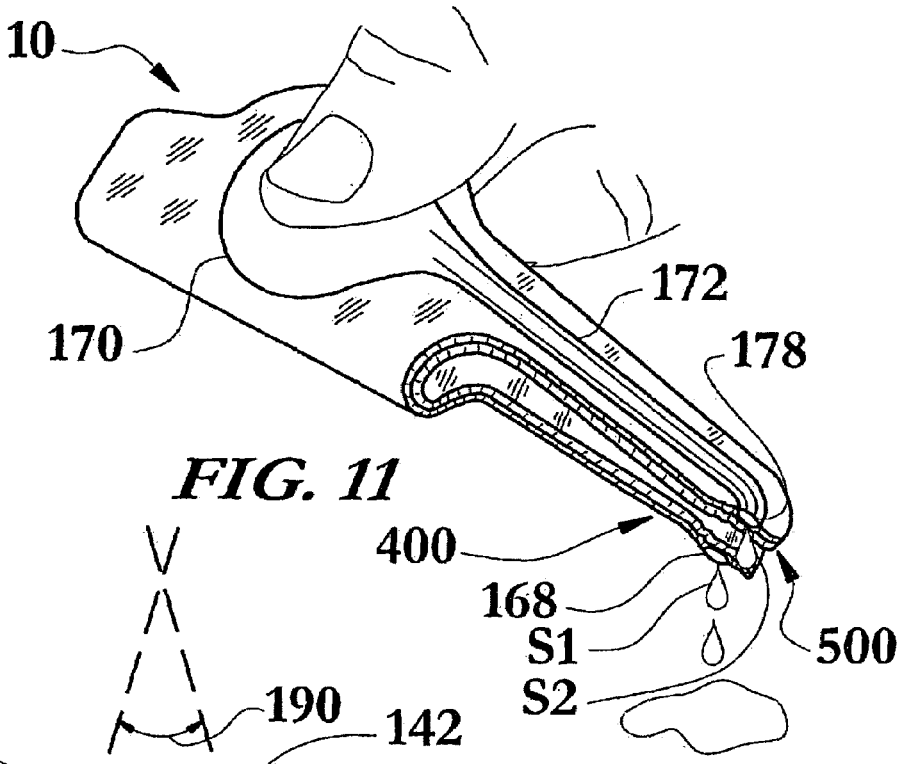
FIG. 11 is a perspective view of an embodiment of the blister package illustrating the application of the flowable substances.

The various elements of the blister package (10) are configured such that in order for a user to access the first and second flowable substances (S1, S2) the following steps must be performed:

(i) apply a force to the base layer tab creation area (250) and the blister layer tab creation area (150) thereby causing separation of a portion of the base layer (200) at the base layer tab creation separation line (240) and a portion of the blister layer (100) at the blister layer tab creation separation line (140) such that a tab (300), having a base layer component (310) and a blister layer component (320), is created, as seen in FIGS. 6 and 7, (ii) remove the tab (300) from the blister package (10) by pulling the tab (300) away from gripping end (14) of the blister package (10), as seen in FIG. 8, thereby tearing the base layer (200) and the blister layer (100) from at least one of the blister layer separation line endpoints (142) and at least one of the base layer separation line endpoints (242) to the blister layer perimeter (110) and the base layer perimeter (210) across the first product application channel (162) and the second product application channel (172) creating a first channel opening (168) and a second channel opening (178) thereby exposing the interior of the first product application channel (162) and the second product application channel (172) to the exterior environment and creating a sinistral wing (400) and a dextral wing (500), as seen in FIG. 9, and (iii) rotate the sinistral wing (400) or the dextral wing (500) so that the first channel opening (168) and the second channel opening (178) pivot toward one another, as seen in FIG. 10, and apply a force to the blister package (10) such that the pressure of the first flowable substance (S1) and the second flowable substance (S2) is increased thereby causing (a) the first flowable substance (S1) to flow from the first product storage cavity (160) through the first product application channel (162) and exit the blister package (10) through the first channel opening (168), and (b) the second flowable substance (S2) to flow from the second product storage cavity (170) through the second product application channel (172) and exit the blister package (10) through the second channel opening (178), as seen in FIG. 11.

The shape and make-up of the separation lines (140, 240) need only facilitate the creation of the tab (300) from application of a reasonable amount of force. The shape and make-up of the separation lines (140, 240) may be selected to create a tab (300) of a predetermined shape and/or having a predetermined tendency to tear. In the present invention, shape and make-up of the separation lines (140, 240) are selected so that as the tab (300) is torn from the blister package (10), the tear traverses across the application channels (162, 172) as it extends to the blister package perimeter (16), thereby creating the first channel opening (168) and the second channel opening (178), as seen in FIGS. 8 and 9. The process of removing the tab (300) also results in the creation of the sinistral wing (400) and the dextral wing (500).

Figure 3:
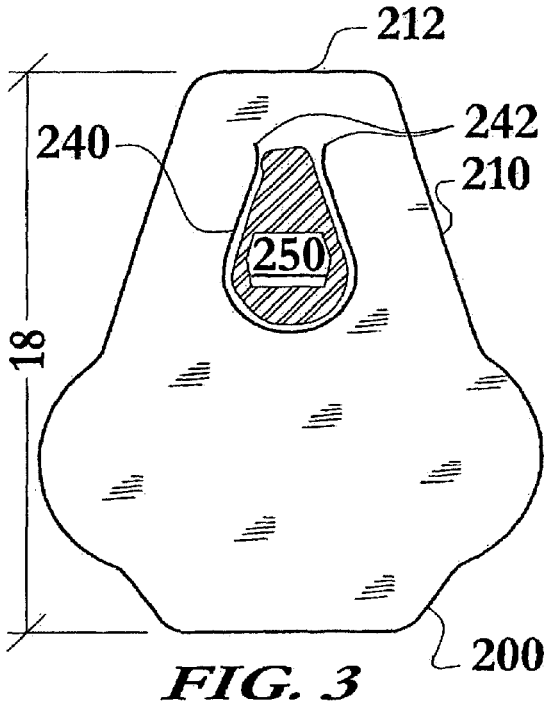
FIG. 3 is a bottom plan view of the embodiment of the blister package of FIG. 1.
Figure 4:
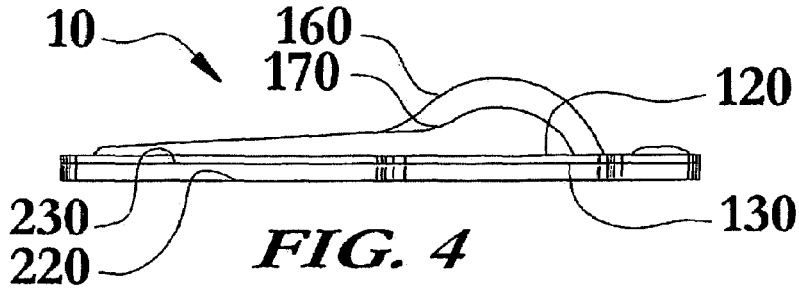
FIG. 4 is a left side elevation view of the embodiment of the blister package of FIG. 1.
Figure 5:
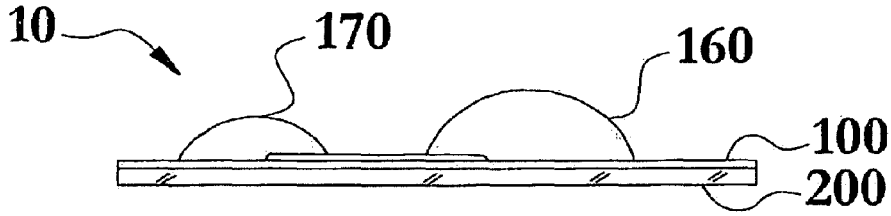
FIG. 5 is a rear side elevation view of the embodiment of the blister package of FIG. 1.
Figure 19:
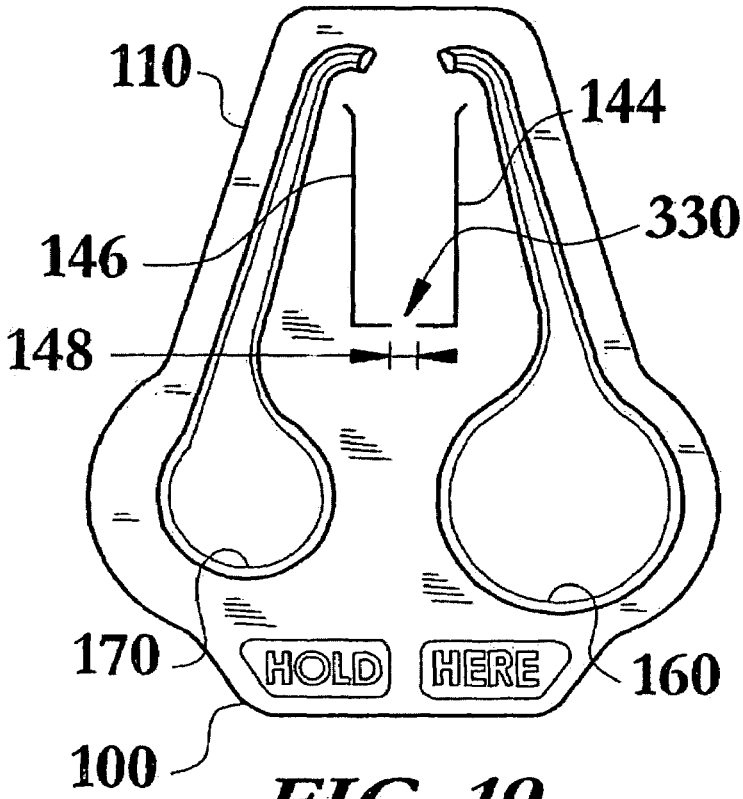
FIG. 19 is a top plan view of an embodiment of the blister package in accordance with the present invention.
Figure 20:
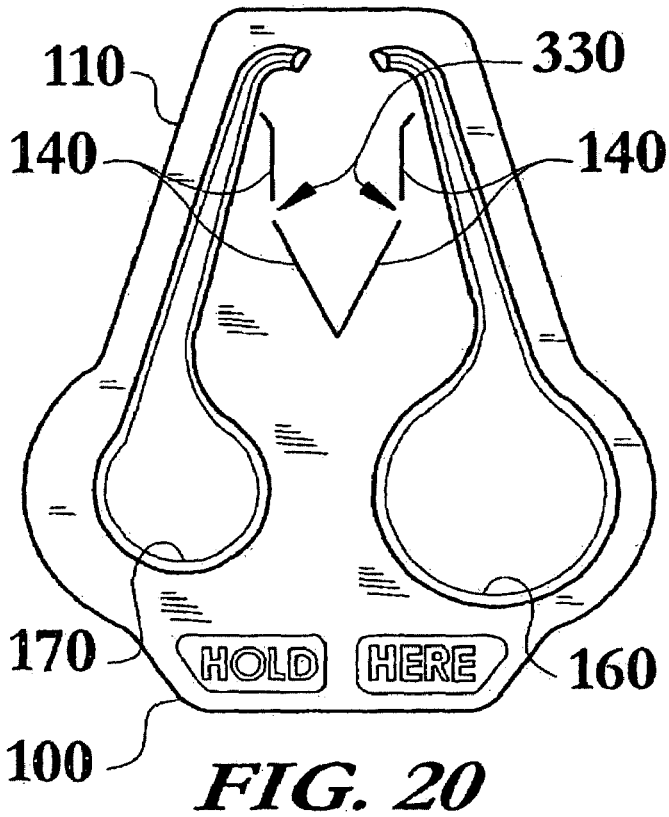
FIG. 20 is a top plan view of an embodiment of the blister package in accordance with the present invention.
Figure 21:
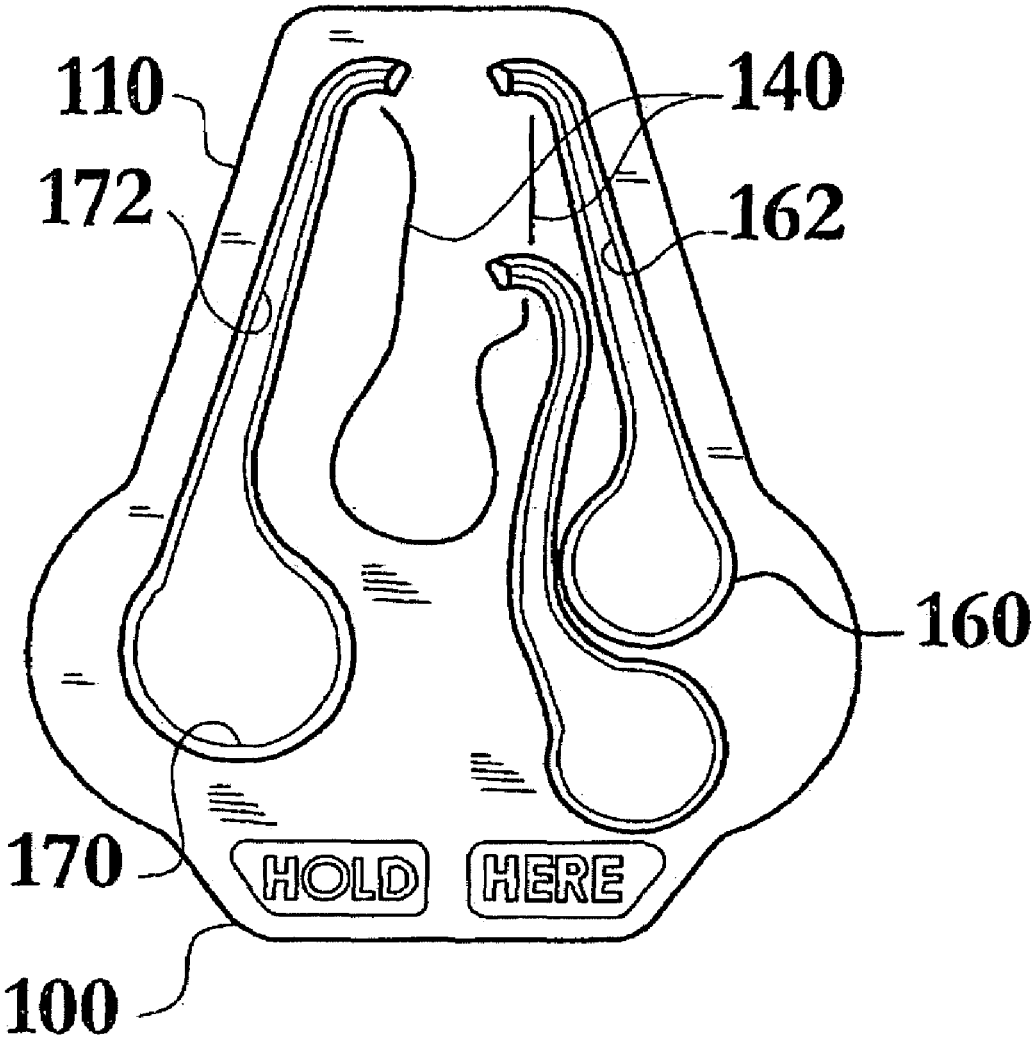
FIG. 21 is a top plan view of an embodiment of the blister package in accordance with the present invention.

In one embodiment, the separation lines (140, 240) are a substantially concave shape that opens toward the administration end (12), as seen, for example, in FIGS. 1-3. Such a configuration cooperates with the natural tendency of a user to grip the blister package (10) with one hand at the gripping end (14) and utilize the opposite hand to manipulate the blister package (10) to access the first and second flowable substances (S1, S2), as seen in FIG. 6. Gripping the blister package (10) in this fashion permits the user to simply roll the thumb, or forefinger, into either tab creation area (150, 250), while exerting a force on the area (150, 250), such that the separation lines (140, 240) allow the release of the tab (300) for subsequent manipulation. While the figures illustrate the tab (300) being created such that it bends upward, or away from the base layer (200), the invention works equally as well if the tab (300) is created from the topside and bends away from the blister layer (100), or in a direction opposite that shown in FIG. 7. Further, one with skill in the art will appreciate the numerous other configurations of separation lines (140, 240) that may be incorporated into the present invention to create the sinistral wing (400) and the dextral wing (500), some of which are illustrated in FIGS. 19-21.

Figure 17:
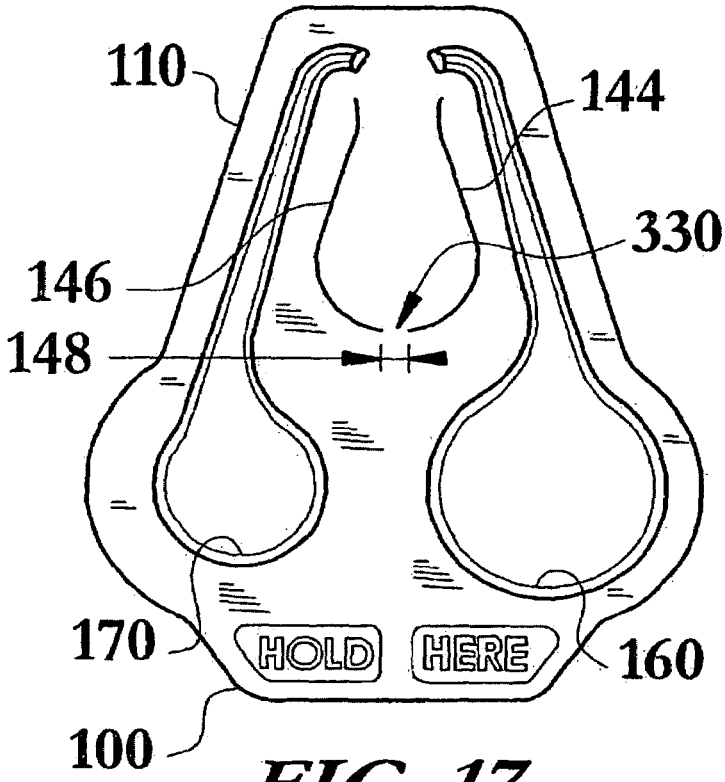
FIG. 17 is a top plan view of an embodiment of the blister package in accordance with the present invention.
Figure 18:
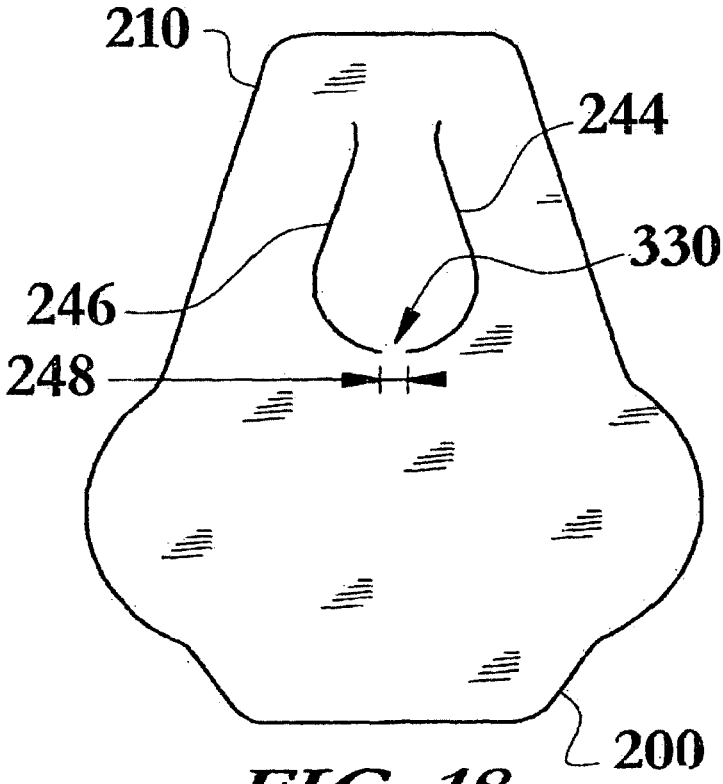
FIG. 18 is a bottom plan view of the embodiment of the blister package of FIG. 17.

Each of the separation lines (140, 240) may be composed of multiple sections. For example, the base layer tab creation separation line (240) may include a first base layer separation line section (244) and a second base layer separation line section (246), as seen in FIG. 18. Similarly, the blister layer tab creation separation line (140) may include a first blister layer separation line section (144) and a second blister layer separation line section (146), as seen in FIGS. 17, 19 and 20. Further, simply because one of the separation lines (140, 240) is composed of multiple sections does not mean that the other separation line (140, 240) must be composed of multiple sections.

In fact, it is often preferred to have at least one of the separation lines (140, 240) composed of multiple sections (144 and 146, 244 and 246) such that the multiple sections (144 and 146, 244 and 246) are separated by a separation line separation distance (148, 248), illustrated in FIGS. 17 and 18. This is particularly true in embodiments wherein the separation lines (140, 240) are slits that cut all the way through the associated layer (100, 200) because the use of multiple sections (144 and 146, 244 and 246) creates a tab retention projection (330) that prevents the unintentional creation of a tab (300). The tab retention projection (330) acts to connect the tab creation area (150, 250) with the remaining body of the layer (100, 200). However, in most of the illustrated embodiments the base layer tab creation separation line (240) and the blister layer tab creation separation line (140) are continuous slits all the way through the associated layer (100, 200) so that the tab (300) can be created by the application of a minimal amount of force to either tab creation area (150, 250). The addition of a tab retention projection (330) increases the amount of force that must be applied to create the tab (300). Therefore, one way of setting the amount of force necessary to create the tab (300) is by altering the magnitude of the separation line separation distance (148, 248). The greater the magnitude of the separation line separation distance (148, 248), the greater the amount of force that must be applied to the tab creation area (150, 250) by the finger, as seen in FIGS. 17–19, to break the tab retention projection (330) and thus permit the tab (300) to rotate out of the plane of the base layer (200). The magnitude of the separation line separation distance (148, 248) is generally between 1/128" and 1/8" (0.2 mm and 3.175 mm), depending on the desired level of resistance to tab formation. Additionally, the blister package (10) may incorporate multiple tab retention projections (330), as seen in FIG. 20. Additionally, FIG. 20 illustrates that the separation lines (140, 240) may be composed of even more than two individual sections.

In one particular embodiment, illustrated in FIGS. 17 and 18, the base layer tab creation separation line (240) includes a first base layer separation line section (244) and a second base layer separation line section (246), and the blister layer tab creation separation line (140) includes a first blister layer separation line section (144) and a second blister layer separation line section (146). In this embodiment the first base layer separation line section (244) and the second base layer separation line section (246) cooperate to form a substantially concave shape that opens toward the administration end (12) of the blister package (10) and the first blister layer separation line section (144) and the second blister layer separation line section (146) cooperate to form a substantially concave shape that opens toward the administration end (12) of the blister package (10). A further variation of this embodiment is one in which the base layer tab creation separation line (240) is a slit extending through the base layer (200) from the base layer exterior surface (220) to the base layer interior surface (230), the blister layer tab creation separation line (140) is a slit extending through the blister layer (100) from the blister layer exterior surface (120) to the blister layer interior surface (130), and further including a tab retention projection (330) connecting the base layer tab creation area (250) and the blister layer tab creation area (150) to the main body of the blister package (10), as seen in FIGS. 17 and 18, thereby preventing the tab (300) from unintentionally leaving the plane of the base layer (100).

In yet a further embodiment, the tab (300) may have only a base layer component (310) or a blister layer component (320). In other words, the blister package (10) may be designed to lack a blister layer tab creation area (150) or a base layer tab creation area (250). Such is the case when the blister layer tab creation separation line (140) or the base layer tab creation separation line (240) does not have an endpoint, or is a closed shape, and extends all the way through the respective blister layer (100) or base layer (200), resulting in the blister layer tab creation area (150) or a base layer tab creation area (250) being removed during manufacturing. It is also contemplated that a hole could be created through both the base layer and the blister layer adjacent the tab (300).

As previously disclosed, once the tab (300) is torn from the blister package (10) the sinistral wing (400) or the dextral wing (500) may be rotated so that the first channel opening (168) and the second channel opening (178) pivot toward one another, as seen in FIG. 10. Although not required, blister layer (100) may incorporate a blister layer fold promoting feature (180) and/or the base layer (200) may incorporate a base layer fold promoting feature (260), illustrated in FIGS. 13 and 14. Such fold promoting features (180, 260) reduce the rigidity of the respective layer (100, 200) and promote the rotation of the sinistral wing (400) and the dextral wing (500) about the fold promoting features (180, 260). The fold promoting features (180, 260) may also provide a visual indication to the user as to the location about which to fold the wings (400, 500).

The fold promoting features (180, 260) may be constructed in any manner that reduces the rigidity of the respective layer (100, 200). For instance, in one embodiment the fold promoting features (180, 260) may include one slit extending from the exterior surface (120, 220) of the particular layer (100, 200) through to the interior surface (130, 230) of the particular layer (100, 200). Additional embodiments may incorporate fold promoting features (180, 260) comprising die cuts, perforations, indentations, score lines, and weakened fracture lines.

Figure 12:
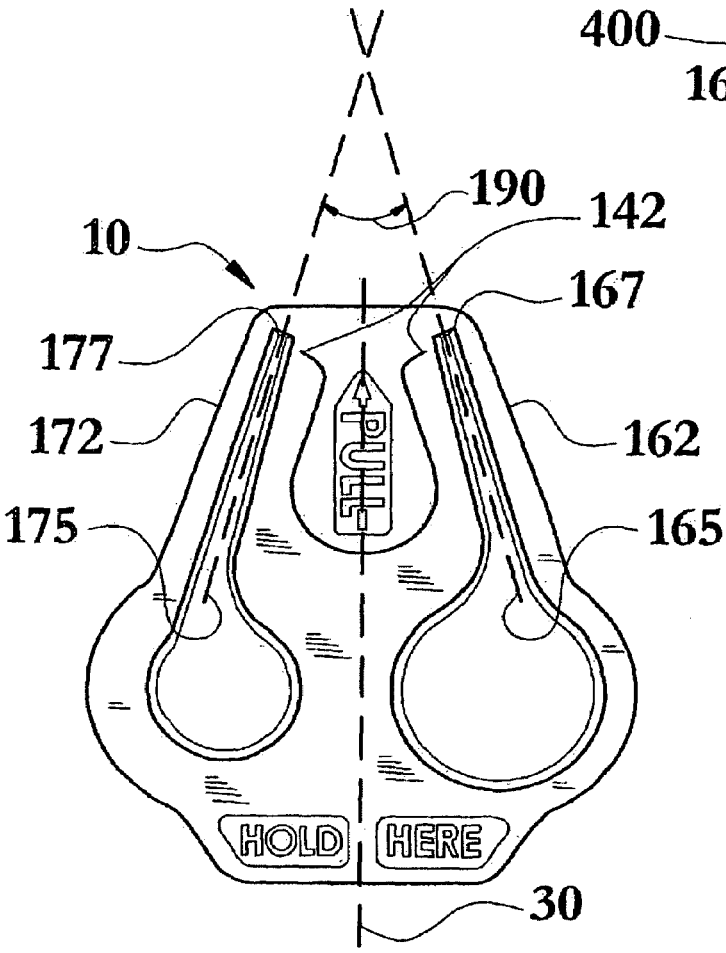
FIG. 12 is a top plan view of an embodiment of the blister package illustrating a discharge convergence angle between the first and second product application channels.

In various embodiments of the present invention, numerous elements are symmetric about a line of symmetry (30), seen first in FIG. 12. Unless stated otherwise reference to the line of symmetry (30) herein refers to a line running substantially parallel to the maximum longitudinal length (18) and extending through the midpoint of the maximum transverse width (20). For example, the embodiment of the blister package (10) of FIGS. 1-5 has the blister package perimeter (16) substantially symmetric about the line of symmetry (30). Further, embodiments incorporating fold promoting features (180, 260) may locate these features substantially on the line of symmetry (30), thus taking advantage of the user's natural tendency to fold items in half, as seen in FIG. 10.

Still further, the blister layer tab creation separation line (140) and/or the base layer tab creation separation line (240) may be substantially symmetrical about the line of symmetry (30). As illustrated in most of the accompanying figures, the blister layer tab creation separation line (140) and the base layer tab creation separation line (240) are generally substantially located between the first product application channel (162) and the second product application channel (172). This location is desirable because is tends to promote the tearing of the layers (100, 200) across the channels (162, 172) as the tear propagates to the perimeter (16, 110, 210). Additionally, this location is particularly intuitive to the user and aids in the understanding of the sequence of events that must occur to access the flowable substances (S1, S2). However, as illustrated in FIG. 21, the tab creation separation lines (140, 240) need not be symmetric about the line of symmetry (30), and in some applications in which a certain degree of difficulty is desired to access the flowable substances (S1, S2) it may be preferable that the tab creation separation lines (140, 240) are not symmetric. One with skill in the art will recognize that the tab (300) is generally symmetric about the line of symmetry (30) in embodiments having the blister layer tab creation separation line (140) and/or the base layer tab creation separation line (240) substantially symmetrical about a line of symmetry (30). The base layer tab creation separation line (240) and the blister layer tab creation separation line (140) may be created in any number of ways, but are generally die cuts, perforations, indentations, score lines, and/or weakened fracture lines.

Figure 13:
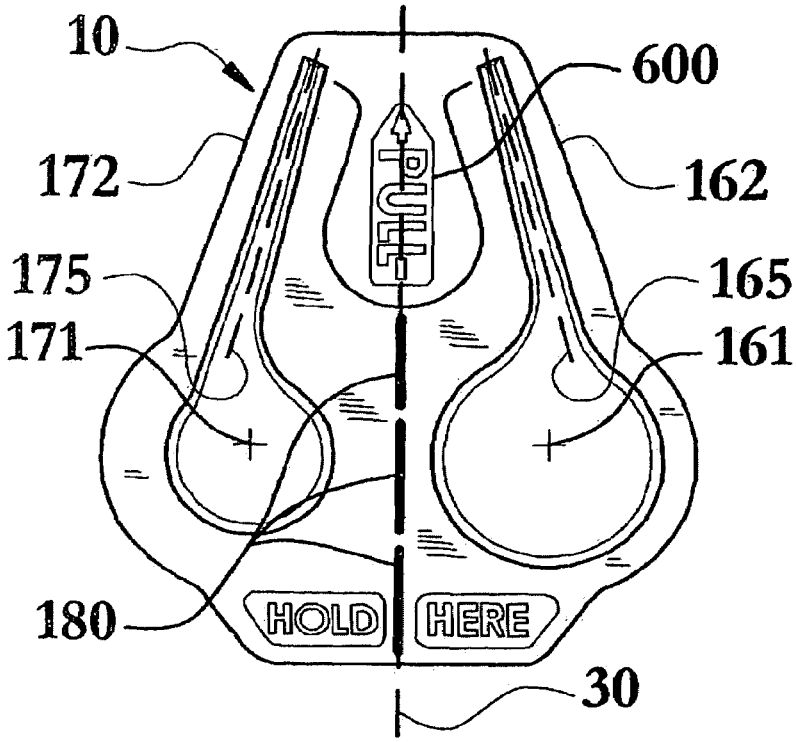
FIG. 13 is a top plan view of a variation of the embodiment of the blister package as seen in FIG. 12.
Figure 14:
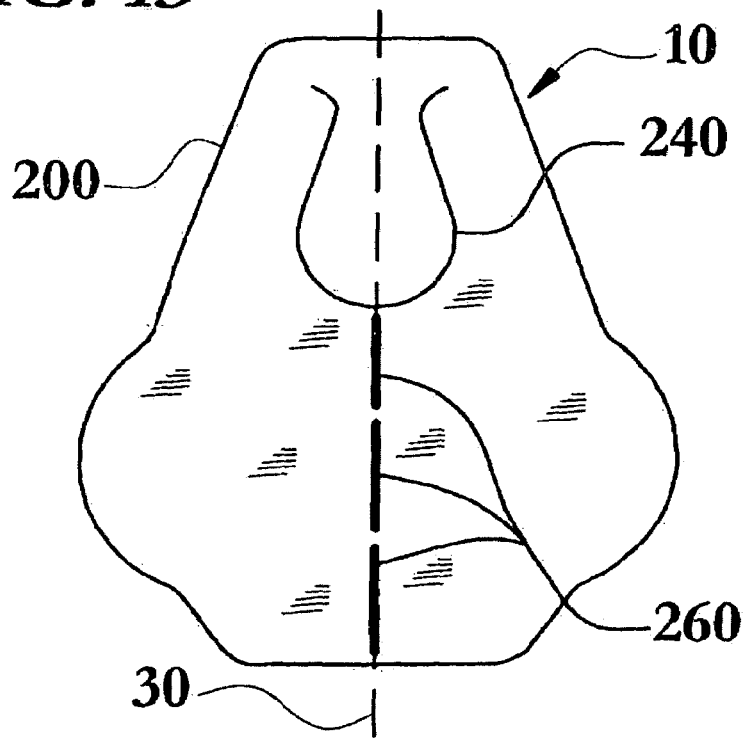
FIG. 14 is a bottom plan view of a variation of the embodiment of the blister package as seen in FIG. 12.
Figure 15:
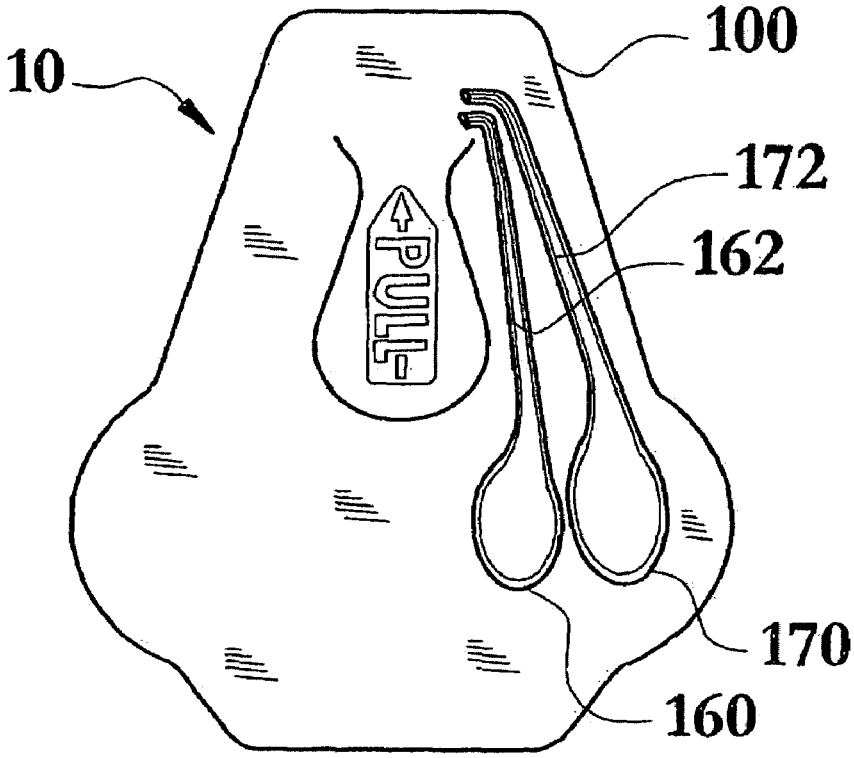
FIG. 15 is a top plan view of an embodiment of the blister package, in accordance with the present invention.

The cavities (160, 170) and the channels (162, 172) may be identical in size and shape or may vary. It is often desirable to dispense different quantities of the first flowable substance (S1) and the second flowable substance (S2). Therefore, the size of the cavities (160, 170) and the channels (162, 172) may be very similar, or they may differ greatly. Further, the viscosity of two flowable substances that need to be stored separately until application is rarely the same. It is not uncommon to have one flowable substance with thickness and flow characteristics similar to toothpaste that must be applied with a second flowable substance having thickness and flow characteristics more similar to water. In such a situation it is desirable to have the channels (162, 172) sized to control the distribution of the substances (S1, S2) so that they may be dispensed evenly, or in a predetermined ratio. In most of the illustrated embodiments the center of the first storage cavity (161) and the center of the second storage cavity (171) are roughly symmetrical about the fold line (30), as seen in FIG. 13, however this is not required, as seen in FIGS. 15 and 21.

In a further embodiment, illustrated in FIG. 12, the first product application channel (162) has a centerline (165) and the second product application channel (172) has a centerline (175). In this embodiment, the first channel centerline (165) and the second channel centerline (175) are substantially symmetric about the line of symmetry (30).

When a projection of the centerline (165, 175) is extended from the distal end (167, 177) of each channel (160, 170) the projections converge, with respect to each other, at a discharge convergence angle (190) of between approximately twenty degrees (20°) and approximately one hundred eighty degrees (180°), as illustrated in FIG. 12. The dashed projection lines extending from the distal ends (167, 177) correspond generally to the flow path of the substances (S1, S2) upon discharge from the package (10). Additionally, in the embodiment of FIG. 17 the discharge convergence angle (190) is approximately one hundred eighty degrees (180°) resulting in the first channel distal end (167) and the second channel distal end (177) pointing substantially toward each other from opposite sides of the line of symmetry (30). Further, with reference again to FIG. 12, the orthogonal distance from the first channel distal end (167) to the line of symmetry (30) is less than the orthogonal distance from the first blister layer separation line endpoint (142) to the line of symmetry (30), and the orthogonal distance from the second channel distal end (177) to the line of symmetry (30) is less than the orthogonal distance from the second blister layer separation line endpoint (142) to the line of symmetry (30), as seen in FIG. 12. Such proximity of the distal ends (167, 177) and the endpoints (142, 242) to the line of symmetry ensure a predetermine path of tear propagation as the tab (300) is removed. Additionally, the outward curvature of the tab creation separation lines (140, 240) near the endpoints (142, 242) provides a predetermined tear path for the blister package (10). Further embodiments may incorporate other features to ensure a predetermined tear location. For instance, either layer (100, 200) of the blister package (10) may include lines of tear propagation. Such lines of tear propagation extend, in-part, from near the endpoints (142, 242) of one, or both, of the tab creation separation lines (140, 240), across the channels (162, 172) and terminate near the perimeter (16, 110, 210). The lines of tear propagation may incorporate die cuts, perforations, indentations, score lines, and weakened fracture lines.

The variations just discussed ensure a predetermined path of tear propagation and therefore, by default, a predetermined location of the first channel opening (168) and second channel opening (178). In most of the embodiments illustrated in FIGS. 1-14 and 17-20, the blister package (10) is designed such that the location of the first channel opening (168) is symmetric about the line of symmetry (30) with the second channel opening (178). In this case, the openings (168, 178) are adjacent to one another when the sinistral wing (400) and the dextral wing (500) are folded such that either the blister layer (100), or base layer (200), of each wing is adjacent to the same layer of the opposite wing (400, 500), as seen in FIGS. 10 and 11. Such positioning ensures that the first flowable substance (S1) and the second flowable substance (S2) exit their associated openings (168, 178) in a side-by-side fashion. Such discharge of the substances (S1, S2) enables mixing of the substances (S1, S2) at the point of application. Further, the design of the blister package (10), and specifically the tab (300) and its predetermined tear path, eliminate the possibility of only opening one of the application channels (168, 178) and improperly administering the flowable substances (S1, S2).

In an alternative embodiment, illustrated in FIG. 15, the first channel opening (168) and the second channel opening (178) are configured so that one of the substances (S1, S2) is applied first and the second substance (S1, S2) is applied over, or on top of, the previously applied substance (S1, S2). Such sequential application of the substances (S1, S2) is preferred in certain medical applications.

A further advantage of the present invention is that the channel openings (168, 178) are not created until immediately prior to application. Therefore, the blister package (10) reduces the risk of the flowable substances (S1, S2) contacting a non-sterile surface of the package (10) during dispensing/application of the substances (S1, S2).

In a preferred embodiment of the invention, the inventive package has indicia embossed into the blister layer and the base layer as seen in FIGS. 1, 2, 6, 7-9, 12, 13, 15-17 and 19-21. The formed arrow on the pull tab (300) and the raised text "PULL" and "HOLD HERE" on the gripping end (14)

play a role in aiding the user in getting a firm grip on the package (10) and also provide instructions on how to properly hold the package (10) during opening. The gripping end (14) and the words "HOLD HERE" help the user avoid accidentally putting pressure on the storage cavities (161, 171) before the pull tab (300) is removed.

In one particular embodiment, seen in FIG. 13, the centers (161, 171) of the cavities (160, 170) are symmetric about the line of symmetry (30), as are the centerlines (165, 175) of the channels (162, 172). Such a configuration is particularly effective because as the sinistral wing (400) and the dextral wing (500) are folded toward one another the force exerted on each cavity (160, 170) is approximately equal. This is in large part due to the fact that the blister package (10) is designed to conveniently fit between the thumb and forefinger of an adult hand so that the folding of the package (10) and associated flattening of the cavities (162, 172) is accomplished with one hand, as seen in FIG. 11. One with skill in the art will appreciate that the present design makes it virtually impossible to not apply approximately the same force to each cavity (160, 170) when the package (10) is gripped and squeezed between the thumb and forefinger of a single hand, regardless of whether the package (10) is folded such that the blister layer (100) comes in contact with itself, or the base layer (200) comes in contact with itself.

While the symmetrical characteristics previously discussed are not necessary to the proper functioning of the present invention, such symmetrical features are often preferable to the user and have been found to increase the user's intuitive understanding of how to manipulate the blister package (10) and how the blister package (10) functions.

The blister layer (100) is preferably made of pharmaceutical grade PVC or other thermoplastic material, such as plastic, polypropylene, polyethylene, styrene, cold-formed foil, or other suitable materials for packaging. The material properties allow the product storage cavities (160, 170) to be compressed, and often squeezed flat, without the material cracking, or failing. The first product storage cavity (160), the first product application channel (162), the second product storage cavity (170), and the second product application channel (172) may be formed by a thermoforming process in which the blister layer material is stretched into a cavity with a vacuum technique to form the cavities (160, 170) and channels (162, 172). In a preferred embodiment, a sheet of suitable material for the blister layer (100) is exposed to heating elements for a pre-determined time. This sheet is then trapped in a forming station where it is subjected to both vacuum and pressure. During this process, the material may also be mechanically assisted into the cavities (160, 170) and channels (162, 172) via matched metal plugs. In another embodiment, the cavities (160, 170) and channels (162, 172) may be formed by using cold-formed foil and cold-form packaging processes. As used herein, "blister package" includes packages made with cold-formed foil and using cold-form packaging processes.

To increase the child-resistance of the blister package (10), the base layer (200) is comprised of a material and thickness that cannot be ruptured by a person pushing on the first flowable substance (S1) in the first product storage cavity (160) or the second flowable substance (S2) in the second product storage cavity (170). The base layer (200) may be comprised of one or more separate layers of material, such as foil and polyester or other suitable child-resistant foils. The base layer (200) is typically comprised of multiple layers, but it could be made of any material deemed child-resistant. Additionally, the child-resistance is further increased by the fact that the previously disclosed method of joining the base layer (200) to the blister layer (100) ensures that peeling, or separation, of the layers (100, 200) from one another by human fingers is extremely difficult, if not impossible.

The inventive package could also be constructed of two layers of flexible pouching material. Pouching material, is a heat sealable multilayer laminates available from the packaging industry. Representative pouch materials include those available from Alcan Inc., of Newark, Calif., and Glenroy Inc., of Menomonee Falls, Wis. These pouching materials may consist of a polyester film, a print, an adhesive layer, a layer of aluminum foil, a layer of adhesive, and a linear low density polyethylene film. These pouching materials are well known in the industry and those skilled in the art will appreciate that good sealing characteristics can be obtained with these materials along with excellent oxygen and moisture barriers. They also have high puncture resistance and excellent tear strength.

Thus, there is further disclosed a disposable single use multi-chamber package for housing and administration of at least a first flowable substance and a second flowable substance comprising a perimeter, an administration end, a gripping end, a maximum longitudinal length, and a maximum transverse width comprising: a) at least one layer of a heat sealable pouch material having an exterior surface and an interior surface, the at least one layer of pouch material being formed with at least a first product storage cavity, a second product storage cavity, a first product application channel, a second product application channel, wherein the first product application channel has a proximal end and is in fluid communication with the first product storage cavity and a distal end; a second product application channel has a proximal end and is in fluid communication with the second product storage cavity and a distal end, and wherein the pouch material has a tab creation separation line having two end points located interior to the pouch material perimeter thereby selectively reducing the strength of the pouch material at the tab creation separation line, generally defining a pouch material tab creation area, and wherein the first product storage cavity, the second product storage cavity, the first product application channel, and the second product application channel do not extend to the pouch material perimeter; b) wherein application of a force to the pouch material tab creation area causes separation of a portion of the pouch material at the tab creation separation line such that a tab is created; removal of the tab from the package by pulling the tab away from the gripping end of the package thereby tearing the pouch material across the first product application channel and the second product application channel creating a first channel opening and a second channel opening thereby exposing the interior of the first product application channel and the second product application channel to the exterior environment; creating a sinistral wing and a dextral wing, rotating the sinistral wing or the dextral wing so that the first channel opening and the second channel opening pivot toward one another and applying a force to the package such that the pressure of a first flowable substance and the second flowable substance is increased thereby causing: a) the first flowable substance to flow from the first product storage cavity through the first product application channel and exit the package through the first channel opening; and b) the second flowable substance to flow from the second product storage cavity through the second product application channel and exit the package through the second channel opening.

As in the case of the blister package, the pouch package can include embossed indicia on the tab and also on the gripping end.

The package (10) of the present invention has only been discussed as having at least two storage cavities (160, 170); however, the package (10) may include additional cavities for housing and administering additional flowable substances. For example, the blister package (10) may further comprise a third storage cavity and a third product application channel for housing and applying a third flowable substance, as seen in FIG. 21 or even additional storage cavities and application channels may be employed.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

INDUSTRIAL APPLICABILITY

The multi-cavity blister package answers a long felt need for a novel blister package for use with flowable substances, including medicaments, and especially liquid medicaments. The present invention discloses a blister package that embodies at least two separate product cavities whereby flowable substance may be kept separated until the time of dispensing and use. Opening of the package is designed to simultaneously and completely open access to the product cavities, and to promote controlled mixing and dispensing of such substances. Additionally, the package embodies a unique folding design such that manual pressure may be applied to the product cavities in a convenient and controlled manner. The blister package of the present invention can be relatively easy to tear for an adult, but not easy for a child to access the substances within the package.

We claim:

1. A disposable single-use multi-chamber package (10) for housing and common administration of at least a first flowable substance (S1) and a second flowable substance (S2) having a perimeter (16), an administration end (12), a gripping end (14), a maximum longitudinal length (18), and a maximum transverse width (20), comprising:

(a) a blister layer (100) having a blister layer perimeter (110) with one or more exterior edges (112), a blister layer exterior surface (120), a blister layer interior surface (130), and formed with at least a first product storage cavity (160), a second product storage cavity (170), a first product application channel (162), a second product application channel (172), wherein the first product application channel (162) has a proximal end (166) in fluid communication with the first product storage cavity (160) and a distal end (167), and the second product application channel (172) has a proximal end (176) in fluid communication with the second product storage cavity (170) and a distal end (177), and wherein the blister layer (100) has a blister layer tab creation separation line (140), having two endpoints (142), located interior to the blister layer perimeter (110) thereby selectively reducing the strength of the blister layer (100) at the blister layer tab creation separation line (140) and generally defining a blister layer tab creation area (150), and wherein the first product storage cavity (160), the second product storage cavity (170), the first product application channel (162), and the second product application channel (172) do not extend to the blister layer perimeter (110);

(b) a base layer (200) having a base layer perimeter (210) with one or more exterior edges (212), a base layer exterior surface (220), a base layer interior surface (230), and a base layer tab creation separation line (240), having two endpoints (242), located interior to the base layer perimeter (210) thereby selectively reducing the strength of the base layer (200) at the base layer tab creation separation line (240) and generally defining a base layer tab creation area (250); wherein at least a portion of the surface area of the base layer interior surface (230) is joined to the blister layer interior surface (130) such that the base layer (200) seals the interior of the first product storage cavity (160), the second product storage cavity (170), the first product application channel (162), and the second product application channel (172) from the exterior environment, and wherein the base layer tab creation separation line (240) and the blister layer tab creation separation line (140) substantially overlay one another and the base layer tab creation area (150) and the blister layer tab creation area (250) substantially overlay one another, and dispensing the first flowable substance (S1) and the second flowable substance (S2) requires:

(i) application of a force to the base layer tab creation area (250) and the blister layer tab creation area (150) thereby causing separation of a portion of the base layer (200) at the base layer tab creation separation line (240) and a portion of the blister layer (100) at the blister layer tab creation separation line (140) such that a tab (300), having a base layer component (310) and a blister layer component (320), is created;

(ii) removal of the tab (300) from the blister package (10) by pulling the tab (300) away from gripping end (14) of the blister package (10) thereby tearing the base layer (200) and the blister layer (100) from at least one of the blister layer separation line endpoints (142) and at least one of the base layer separation line endpoints (242) to the blister layer perimeter (110) and the base layer perimeter (210) across the first product application channel (162) and the second product application channel (172) creating a first channel opening (168) and a second channel opening (178) thereby exposing the interior of the first product application channel (162) and the second product application channel (172) to the exterior environment and creating a sinistral wing (400) and a dextral wing (500), and;

(iii) rotating the sinistral wing (400) or the dextral wing (500) so that the first channel opening (168) and the second channel opening (178) pivot toward one another, and applying a force to the blister package (10) such that the pressure of the first flowable substance (S1) and the second flowable substance (S2) is increased thereby causing: (a) the first flowable substance (S1) to flow from the first product storage cavity (160) through the first product application channel (162) and exit the blister package (10)

through the first channel opening (168); and, (b) the second flowable substance (S2) to flow from the second product storage cavity (170) through the second product application channel (172) and exit the blister package (10) through the second channel opening (178).

2. The package (10) of claim 1, further including embossed indicia.

3. The package of claim 2, wherein said indicia is located on said tab (300).

4. The package of claim 2, wherein said indicia is located on said gripping end (14).

5. The (10) of claim 1, further including a blister layer fold promoting feature (180) in the blister layer (100) that reduces the rigidity of the blister layer (100) and promotes the rotation of the sinistral wing (400) and the dextral wing (500) about the blister layer fold promoting feature (180).

6. The package (10) of claim 5, wherein the blister layer fold promoting feature (180) is at least one slit extending from the blister layer exterior surface (120) to the blister layer interior surface (130).

7. The package (10) of claim 1, further including a base layer fold promoting feature (260) in the base layer (200) that reduces the rigidity of the base layer (200) and promotes the rotation of the sinistral wing (400) and the dextral wing (500) about the base layer fold promoting feature (260).

8. The package (10) of claim 7, wherein the base layer fold promoting feature (260) is at least one slit extending from the base layer exterior surface (220) to the base layer interior surface (230).

9. The package (10) of claim 1, wherein the blister package perimeter (16) is substantially symmetrical about a line of symmetry (30) running substantially parallel to the maximum longitudinal length (18) and extending through the midpoint of the maximum transverse width (20).

10. The package (10) of claim 9, wherein the blister layer fold promoting feature (180) is located substantially on the line of symmetry (30).

11. The package (10) of claim 9, wherein the base layer fold promoting feature (260) is located substantially on the line of symmetry (30).

12. The package (10) of claim 1, wherein the blister layer tab creation separation line (140) is substantially symmetrical about a line of symmetry (30) running substantially parallel to the maximum longitudinal length (18) and extending through the midpoint of the maximum transverse width (20) and the blister layer tab creation separation line (140) is substantially located between the first product application channel (165) and the second product application channel (175).

13. The package (10) of claim 12, wherein the blister layer tab creation separation line (140) is substantially concave in shape opening toward the blister package administration end (12).

14. The package (10) of claim 1, wherein the first product application channel (162) has a centerline (165) and the second product application channel (172) has a centerline (175), and a projection of the first channel centerline (165) from the first channel distal end (167) converges toward a projection of the second channel centerline (175) from the second channel distal end (177) at a discharge convergence angle (190) of between zero degrees and one hundred eighty degrees.

15. The package (10) of claim 14, wherein the discharge convergence angle (190) is one hundred eighty degrees such that the first channel distal end (167) and the second channel distal end (177) point substantially toward each other from opposite sides of the line of symmetry (30), and the orthogonal distance from the first channel distal end (167) to the line of symmetry (30) is less than the orthogonal distance from the first blister layer separation line endpoint (142) to the line of symmetry (30), and the orthogonal distance from the second channel distal end (177) to the line of symmetry (30) is less than the orthogonal distance from the second blister layer separation line endpoint (142) to the line of symmetry (30).

16. The package (10) of claim 1, wherein the base layer tab creation separation line (240) is substantially symmetrical about a line of symmetry (30) running substantially parallel to the maximum longitudinal length (18) and extending through the midpoint of the maximum transverse width (20) and the base layer tab creation separation line (240) is substantially located between the first product application channel (165) and the second product application channel (175).

17. The package (10) of claim 1, wherein the tab (300) is substantially symmetrical about a line of symmetry (30) running substantially parallel to the maximum longitudinal length (18) and extending through the midpoint of the maximum transverse width (20).

18. The package (10) of claim 1, wherein the blister layer tab creation separation line (140) includes a first blister layer separation line section (144) and a second blister layer separation line section (146).

19. The package (10) of claim 1, wherein the base layer (200) is comprised of a material and thickness that cannot be readily ruptured by a human finger pushing on the first flowable substance (S1) in the first product storage cavity (160) or the second flowable substance (S2) in the second product storage cavity (170).

20. The package (10) of claim 1, wherein the blister layer (100) is formed of a thermoplastic or cold-form material.

21. The package (10) of claim 1, wherein the first product storage cavity (160), the second product storage cavity (170), the first product application channel (165), and the second product application channel (175) are thermoformed or cold-formed in the blister layer (200).

22. The package (10) of claim 1, wherein the portions of the base layer (200) and the blister layer (100) that are joined together cannot be readily torn from the base layer perimeter (210) or the blister layer perimeter (110).

23. The package (10) of claim 1, wherein the base layer tab creation separation line (240) and the blister layer tab creation separation line (140) comprise one or more of the group consisting of die cuts, perforations, indentations, score lines, and weakened fracture lines.

24. A disposable single-use multi-cavity package (10) for housing and administration of at least a first flowable substance (S1) and a second flowable substance (S2), having an administration end (12), a gripping end (14), a maximum longitudinal length (18), a maximum transverse width (20), and a perimeter (16) that is substantially symmetrical about a line of symmetry (30) running substantially parallel to the maximum longitudinal length (18) and extending through the midpoint of the maximum transverse width (20), comprising:

a blister layer (100) having a blister layer perimeter (110) with one or more exterior edges (112), a blister layer exterior surface (120), a blister layer interior surface (130), and formed with at least a first product storage cavity (160), a second product storage cavity (170), a first product application channel (162), a second product application channel (172), wherein the first product application channel (162) has a proximal end (166) in fluid communication with the first product storage cavity (160) and a distal end (167), and the second product application channel (172) has a proximal end (176) in fluid communication with the second product storage cavity (170) and a distal end (177), and wherein the blister layer (100) has a blister layer tab creation separation line (140), having two endpoints (142), located interior to the blister layer perimeter (110) thereby selectively reducing the strength of the blister layer (100) at the blister layer tab creation separation line (140) and generally defining a blister layer tab creation area (150), and wherein the first product storage cavity (160), the second product storage cavity (170), the first product application channel (162), and the second product application channel (172) do not extend to the blister layer perimeter (110), and including a blister layer fold promoting feature (180) in the blister layer (100) located substantially on the line of symmetry (30) that reduces the rigidity of the blister layer (100);

a base layer (200) having a base layer perimeter (210) with one or more exterior edges (212), a base layer exterior surface (220), a base layer interior surface (230), and a base layer tab creation separation line (240), having two endpoints (242), located interior to the base layer perimeter (210) thereby selectively reducing the strength of the base layer (200) at the base layer tab creation separation line (240) and generally defining a base layer tab creation area (250), and including a base layer fold promoting feature (260) in the base layer (200) located substantially on the line of symmetry (30) that reduces the rigidity of the base layer (200); wherein at least a 3.0 mm wide surface area of the base layer interior surface (230) is joined to the blister layer interior surface (130) such that the base layer (200) seals the interior of the first product storage cavity (160), the second product storage cavity (170), the first product application channel (162), and the second product application channel (172) from the exterior environment, and wherein the base layer tab creation separation line (240) and the blister layer tab creation separation line (140) substantially overlay one another and the base layer tab creation area (150) and the blister layer tab creation area (250) substantially overlay one another.

25. A method for dispensing a first flowable substance (S1) and a second flowable substance (S2) from a blister package, said method comprising:

(i) application of a force to a base layer tab creation area (250) and a blister layer tab creation area (150) thereby causing separation of a portion of the base layer (200) at the base layer tab creation separation line (240) and a portion of the blister layer (100) at a blister layer tab creation separation line (140) such that a tab (300), having a base layer component (310) and a blister layer component (320), is created;

(ii) removal of the tab (300) from the blister package (10) by pulling the tab (300) away from a gripping end (14) of the blister package (10) thereby tearing the base layer (200) and the blister layer (100) from at least one of the blister layer separation line endpoints (142) and at least one of the base layer separation line endpoints (242) to the blister layer perimeter (110) and the base layer perimeter (210) across a first product application channel (162) and a second product application channel (172) creating a first channel opening (168) and a second channel opening (178) thereby exposing the interior of the first product application channel (162) and the second product application channel (172) to the exterior environment and creating a sinistral wing (400) and a dextral wing (500); and (iii) rotating the sinistral wing (400) or the dextral wing (500) about a blister layer fold promoting feature (180) and a base layer fold promoting feature (260) so that the first channel opening (168) and the second channel opening (178) pivot toward one another, and applying a force to the blister package (10) such that the pressure of the first flowable substance (S1) and the second flowable substance (S2) is increased thereby causing (a) the first flowable substance (S1) to flow from the first product storage cavity (160) through the first product application channel (162) and exit the blister package (10) through the first channel opening (168), and (b) the second flowable substance (S2) to flow from the second product storage cavity (170) through the second product application channel (172) and exit the blister package (10) through the second channel opening (178).

26. The package (10) of claim 24, wherein the blister layer tab creation separation line (140) is substantially symmetrical about a line of symmetry (30) running substantially parallel to the maximum longitudinal length (18) and extending through the midpoint of the maximum transverse width (20) and the blister layer tab creation separation line (140) is substantially located between the first product application channel (165) and the second product application channel (175).

27. The package (10) of claim 26, wherein the blister layer tab creation separation line (140) is substantially concave in shape opening toward the blister package administration end (12).

28. The package (10) of claim 24, wherein the first product application channel (162) has a centerline (165) and the second product application channel (172) has a centerline (175), and a projection of the first channel centerline (165) from the first channel distal end (167) converges toward a projection of the second channel centerline (175) from the second channel distal end (177) at a discharge convergence angle (190) of between approximately twenty degrees and approximately one hundred and eighty degrees.

29. The package (10) of claim 27, wherein the discharge convergence angle (190) is one hundred eighty degrees such that the first channel distal end (167) and the second channel distal end (177) point substantially toward each other from opposite sides of the line of symmetry (30), and the orthogonal distance from the first channel distal end (167) to the line of symmetry (30) is less than the orthogonal distance from the first blister layer separation line endpoint (142) to the line of symmetry (30), and the orthogonal distance from the second channel distal end (177) to the line of symmetry (30) is less than the orthogonal distance from the second blister layer separation line endpoint (142) to the line of symmetry (30).

30. The package (10) of claim 26, wherein the first channel distal end (167) and the second channel distal end (177) point substantially toward each other from opposite sides of the line of symmetry (30), and the orthogonal distance from the first channel distal end (167) to the line of symmetry (30) is less than the orthogonal distance from the first blister layer separation line endpoint (142) to the line of symmetry (30), and the orthogonal distance from the second channel distal end (177) to the line of symmetry (30) is less than the orthogonal distance from the second blister layer separation line endpoint (142) to the line of symmetry (30).

31. The package (10) of claim 24, wherein the base layer tab creation separation line (240) is substantially symmetrical about a line of symmetry (30) running substantially parallel to the maximum longitudinal length (18) and extending through the midpoint of the maximum transverse width (20) and the base layer tab creation separation line (240) is substantially located between the first product application channel (165) and the second product application channel (175).

32. The package (10) of claim 24, wherein the tab (300) is substantially symmetrical about a line of symmetry (30) running substantially parallel to the maximum longitudinal length (18) and extending through the midpoint of the maximum transverse width (20).

33. The package (10) of claim 24, further including embossed indicia.

34. The package (10) of claim 33, wherein said indicia is located on said tab (300).

35. The package (10) of claim 33, wherein said indicia is located on said gripping end (14).

36. A disposable single-use multi-cavity blister package (10) for housing and common administration of at least a first flowable substance (S1) and a second flowable substance (S2) having an administration end (12), a gripping end (14), a maximum longitudinal length (18), a maximum transverse width (20), and a perimeter (16) that is substantially symmetrical about a line of symmetry (30) running substantially parallel to the maximum longitudinal length (18) and extending through the midpoint of the maximum transverse width (20), comprising:

a blister layer (100) having a blister layer perimeter (110) with one or more exterior edges (112), a blister layer exterior surface (120), a blister layer interior surface (130), and formed with at least a first product storage cavity (160), a second product storage cavity (170), a first product application channel (162), a second product application channel (172), wherein the first product application channel (162) has a proximal end (166) in fluid communication with the first product storage cavity (160) and a distal end (167), and the second product application channel (172) has a proximal end (176) in fluid communication with the second product storage cavity (170) and a distal end (177), and wherein the blister layer (100) has a blister layer tab creation separation line (140), having two endpoints (142), that is substantially concave in shape, opening toward the administration end (12), and is substantially symmetric about the line of symmetry (30) and located interior to the blister layer perimeter (110) thereby selectively reducing the strength of the blister layer (100) at the blister layer tab creation separation line (140) and generally defining a blister layer tab creation area (150), and wherein the first product storage cavity (160), the second product storage cavity (170), the first product application channel (162), and the second product application channel (172) do not extend to the blister layer perimeter (110), and including a blister layer fold promoting feature (180) in the blister layer (100) located substantially on the line of symmetry (30) that reduces the rigidity of the blister layer (100) including at least one slit extending from the blister layer exterior surface (120) to the blister layer interior surface (130);

a base layer (200) having a base layer perimeter (210) with one or more exterior edges (212), a base layer exterior surface (220), a base layer interior surface (230), and a base layer tab creation separation line (240), having two endpoints (242), that is substantially concave in shape, opening toward the administration end (12), and is substantially symmetric about the line of symmetry (30) and located interior to the base layer perimeter (210) thereby selectively reducing the strength of the base layer (200) at the base layer tab creation separation line (240) and generally defining a base layer tab creation area (250), and including a base layer fold promoting feature (260) in the base layer (200) located substantially on the line of symmetry (30) that reduces the rigidity of the base layer (200) including at least one slit extending from the base layer exterior surface (220) to the base layer interior surface (230); wherein the first product application channel (162) has a centerline (165) and the second product application channel (172) has a centerline (175), and the first channel centerline (165) and the second channel centerline (175) are substantially symmetric about the line of symmetry (30), and a projection of the first channel centerline (165) from the first channel distal end (167) converges toward a projection of the second channel centerline (175) from the second channel distal end (177) at a discharge convergence angle (190) of approximately one hundred and eighty degrees such that the first channel distal end (167) and the second channel distal end (177) point substantially toward each other from opposite sides of the line of symmetry (30), and the orthogonal distance from the first channel distal end (167) to the line of symmetry (30) is less than the orthogonal distance from the first blister layer separation line endpoint (142) to the line of symmetry (30), and the orthogonal distance from the second channel distal end (177) to the line of symmetry (30) is less than the orthogonal distance from the second blister layer separation line endpoint (142) to the line of symmetry (30); and at least a portion of the surface area of the base layer interior surface (230) is joined to the blister layer interior surface (130) such that the base layer (200) seals the interior of the first product storage cavity (160), the second product storage cavity (170), the first product application channel (162), and the second product application channel (172) from the exterior environment, and wherein the base layer tab creation separation line (240) and the blister layer tab creation separation line (140) substantially overlay one another and the base layer tab creation area (150) and the blister layer tab creation area (250) substantially overlay one another, and dispensing the first flowable substance (S1) and the second flowable substance (S2) requires:

(i) application of a force to the base layer tab creation area (250) and the blister layer tab creation area (150) thereby causing separation of a portion of the base layer (200) at the base layer tab creation separation line (240) and a portion of the blister layer (100) at the blister layer tab creation separation line (140) such that a tab (300), substantially symmetric about the line of symmetry (30) and having a base layer component (310) and a blister layer component (320), is created, (ii) removal of the tab (300) from the blister package (10) by pulling the tab (300) away from gripping end (14) of the blister package (10) thereby tearing the base layer (200) and the blister layer (100) from at least one of the blister layer separation line endpoints (142) and at least one of the base layer separation line endpoints (242) to the blister layer perimeter (110) and the base layer perimeter (210) across the first product application channel (162) and the second product application channel (172) creating a first channel opening (168) and a second channel opening (178) thereby exposing the interior of the first product application channel (162) and the second product application channel (172) to the exterior environment and creating a sinistral wing (400) and a dextral wing (500), and;

(iii) rotating the sinistral wing (400) or the dextral wing (500) about the blister layer fold promoting feature (180) and the base layer fold promoting feature (260) so that the first channel opening (168) and the second channel opening (178) pivot toward one another, and applying a force to the blister package (10) such that the pressure of the first flowable substance (S1) and the second flowable substance (S2) is increased thereby causing (a) the first flowable substance (S1) to flow from the first product storage cavity (160) through the first product application channel (162) and exit the blister package (10) through the first channel opening (168), and (b) the second flowable substance (S2) to flow from the second product storage cavity (170) through the second product application channel (172) and exit the blister package (10) through the second channel opening (178).

37. A disposable single use multi-chamber package for housing and administration of at least a first flowable substance and a second flowable substance comprising a perimeter, an administration end, a gripping end, a maximum longitudinal length, and a maximum transverse width comprising:

a) at least one layer of a heat sealable pouch material having an exterior surface and an interior surface, the at least one layer of pouch material being formed with at least a first product storage cavity, a second product storage cavity, a first product application channel, a second product application channel, wherein the first product application channel has a proximal end and is in fluid communication with the first product storage cavity and a distal end; a second product application channel has a proximal end and is in fluid communication with the second product storage cavity and a distal end, and wherein the pouch material has a tab creation separation line having two end points located interior to the pouch material perimeter thereby selectively reducing the strength of the pouch material at the tab creation separation line, generally defining a pouch material tab creation area, and wherein the first product storage cavity, the second product storage cavity, the first product application channel, and the second product application channel do not extend to the pouch material perimeter;

b) wherein application of a force to the pouch material tab creation area causes separation of a portion of the pouch material at the tab creation separation line such that a tab is created; removal of the tab from the package by pulling the tab away from the gripping end of the package thereby tearing the pouch material across the first product application channel and the second product application channel creating a first channel opening and a second channel opening thereby exposing the interior of the first product application channel and the second product application channel to the exterior environment; creating a sinistral wing and a dextral wing, rotating the sinistral wing or the dextral wing so that the first channel opening and the second channel opening pivot toward one another and applying a force to the package such that the pressure of a first flowable substance and the second flowable substance is increased thereby causing:

a) the first flowable substance to flow from the first product storage cavity through the first product application channel and exit the package through the first channel opening; and b) the second flowable substance to flow from the second product storage cavity through the second product application channel and exit the package through the second channel opening.

* * * * *

UNITED STATES PATENT AND TRADEMARK OFFICE

CERTIFICATE OF CORRECTION

PATENT NO. : 7,325,703 B2
APPLICATION NO. : 11/154356
DATED : February 5, 2008
INVENTOR(S) : Victor Gherdan et al.

It is certified that error appears in the above-identified patent and that said Letters Patent is hereby corrected as shown below:

COLUMN 2

Line 59, “is” should read --are--.

COLUMN 6

Line 50, “is” should read --are--.

COLUMN 11

Line 9, “is” (second occurrence) should read --it--; and
Line 20, “are not” should read --not be--.

COLUMN 12

Line 14, “predetermine” should read --predetermined--; and
Line 22, “in-part,” should read --in part,--.

COLUMN 14

Line 7, “laminates” should read --laminate--.

COLUMN 15

Line 21, “and or” should read --and/or--.

COLUMN 16

Line 9, “perimeter (110);” should read --perimeter (110); and--.

COLUMN 17

Line 13, “The (10)” should read --The package (10)--.

COLUMN 19

Line 20, “layer (100);” should read --layer (100); and--.

UNITED STATES PATENT AND TRADEMARK OFFICE

CERTIFICATE OF CORRECTION

PATENT NO. : 7,325,703 B2
APPLICATION NO. : 11/154356
DATED : February 5, 2008
INVENTOR(S) : Victor Gherdan et al.

It is certified that error appears in the above-identified patent and that said Letters Patent is hereby corrected as shown below:

COLUMN 21

Line 65, "surface (130);" should read --surface (130); and--.

COLUMN 23

Line 12, "and;" should read --and--.

Signed and Sealed this

Seventh Day of October, 2008

JON W. DUDAS
*Director of the United States Patent and Trademark Office*